United States Patent [19]

Keller

[11] 4,294,025

[45] Oct. 13, 1981

[54] SOLE ATTACHMENT FOR FACILITATING WALKING

[75] Inventor: Andre Keller, Vira, Switzerland

[73] Assignee: Roll & Go AG, Stansstad, Switzerland

[21] Appl. No.: 121,993

[22] Filed: Feb. 19, 1980

[51] Int. Cl.[3] ..... A43B 5/00

[52] U.S. Cl. ..... 36/132

[58] Field of Search ..... 36/132, 136; 12/120.5

[56] References Cited

FOREIGN PATENT DOCUMENTS 2746052 4/1979 Fed. Rep. of Germany ..... 36/132

580927 10/1976 Switzerland ..... 36/132

*Primary Examiner*—Patrick D. Lawson

*Attorney, Agent, or Firm*—Werner W. Kleeman

[57] ABSTRACT

A sole attachment or undersupport in the form of a plate attached to the sole of footwear, in particular a ski boot, wherein the lower tread or walking surface is domed in the direction of the sole. The plate is provided with holder elements which engage over the sole. One of the holder elements is rigid, the other holder element is movable. Fixing means, for instance pins are provided, which engage into bores provided at the ski boot sole. The plate consists of telescopically adjustable plate portions. There are also provided recesses in the tread surface and adjustable anti-skid elements, such as adjustable pins serving to prevent slipping or skidding by the user. Holders can be provided for securing the sole attachment at a ski when it is not worn at the ski boot or the like.

14 Claims, 9 Drawing Figures

SOLE ATTACHMENT FOR FACILITATING WALKING

BACKGROUND OF THE INVENTION

The present invention relates to a new and improved construction of a sole attachment for facilitating walking, especially for use in conjunction with ski boots and the like.

Generally speaking, the sole attachment or undersupport of the present invention is of the type comprising a plate or plate member, the upper surface of which is structured so that it can be mounted at the sole of the boot or other footwear. This plate member is provided with a lower tread or contact surface, also referred to as a walking surface, which is arched or domed in the direction of the sole, and such plate member is also provided with attachment or securing devices for the attachment thereof at the boot or other footwear. A sole attachment of this type is known to the art from Swiss Pat. No. 516,290.

SUMMARY OF THE INVENTION

It is a primary object of the present invention to improve upon such state-of-the-art sole attachment with the intent of devising a sole attachment which can be quickly secured to an article of footwear, especially a ski boot, and additionally can again rapidly be disconnected therefrom, wherein the sole attachment when connected with the ski boot or the like, is positively secured thereto.

A further significant object of the present invention aims at providing a new and improved construction of a sole attachment for facilitating walking with footwear, especially ski boots, wherein the sole attachment can be easily fitted to various boot sizes and is structured such that when worn by the user there is less likelihood of he or she slipping upon snow or ice.

A further significant object of the present invention is directed to a new and improved construction of sole attachment for facilitating walking with footwear, especially ski boots and the like, which sole attachment is relatively simple in construction and design, economical to manufacture, extremely easy to use, not readily subject to breakdown or malfunction, and can be mounted at and disconnected again from the ski boot with relative ease.

Now in order to implement these and still further objects of the invention, which will become more readily apparent as the description proceeds, the sole attachment for facilitating walking as contemplated by the present development, is manifested by the features that the plate or plate member is provided at its ends with holder elements or holders which engage over the sole of the boot or the like. At least one of the holder elements is formed as one-piece or integrally with the plate member, and at least one of the holder elements is elastically movable into its effectual position and out of such effectual position. The plate member is provided at its upper surface with at least one fixation or arresting element intended to be inserted into a related recess or the like provided at the ski boot sole.

With such construction the elastic attachment device enables simple engagement at the ski boot and equally disconnection of the elastically movable holder element, either manually or with the aid of a ski pole, by way of example.

The fixation or arresting element additionally safeguards against the sole attachment laterally sliding at the boot.

Preferably, the plate member can comprise two mutually telescopically adjustable plate portions or elements. By mutually displacing the plate portions it is possible to simply adjust the sole attachment to different sizes of boot.

The surfaces of the plate portions or elements, extending transversely with respect to the lengthwise direction of the plate member and bounding a separation joint at the plate member, advantageously possess portions which tend to diverge with respect to the lower surface of the plate member. In this way there is obtained the formation of a joint even when the plate portions or elements are closely abutting one another, this joint improving the anti-skid or slide characteristics of the sole attachment upon snow or ice. The elastically movable holder element can be inherently structured to be elastic and formed of one-piece or integrally with the plate member. In this way there is obtained a simple construction of the attachment device which, with appropriate selection of the material from which there is formed the elastically movable holder element, also affords a robust construction of the attachment device.

However, the elastically movable holder element also can be movably mounted in relation to the plate member and can be moved by elastic means with respect to the ski boot sole. The movable mounting can be constituted, for instance, by a parallel guide arrangment or a rotatable support or bearing arrangement. In this way there is obtained a construction which is suitable for greater ranges of movement and also for the application of greater holding forces, but at the expense of a somewhat more complicated construction.

The domed lower surface can be formed at least at one sole part which is then attached to the plate member or the plate portions forming the plate member, as the case may be. The thus afforded possibility of disconnecting the plate or plate portions from a sole portion enables separate selection of suitable materials for forming the plate member and the sole portion. Thus, for instance, the plate member can be fabricated from a harder plastic material than the sole portion or sole portions. Also it is easily possible to then carry out a replacement or repair when the sole portion or portions become worn.

The domed or arched lower surface can be provided with depressions or recesses providing protection against slipping or sliding. At least given ones of such depressions or recesses can have the shape of mirror-image letters of the alphabet. Hence, with this design there is not only obtained an anti-skid protection, in a manner as is conventional in footwear soles, rather additionally there is also possible the formation of readable impressions of the sole attachment upon the snow.

Additionally, the sole attachment can possess anti-skid means, for instance in the form of pins, which can be extended out of the lower surface of the sole attachment so as to provide for positive protection against the user slipping or sliding during walking. These anti-slipping or anti-skid pins or equivalent structure are particularly useful when the user intends to walk with the sole attachment upon surfaces covered with ice.

Additionally, it is also within the teachings of the invention to provide holders or the like which enable securing the sole attachment at the ski during skiing. These holders together with the sole attachment not only render possible storage of the sole attachments without any problem during skiing, but at the same time afford the added beneficial effect, —similar to the conventionally employed anti-cross-over devices which are frequently secured in known manner to the skis—of simultaneously working like such anti-ski cross-over devices which prevent unintentional crossing of the skis during skiing.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 9 is a fragmentary view of a modified form of sole attachment, like in the arrangment of FIG. 1, wherein there is illustrated a different construction of the fixation element safeguarding against lateral shifting of the sole attachment with respect to the boot or the like.

DETAILED DESCRIPTION OF THE PREFERRED EMBODIMENTS

Figure 1:
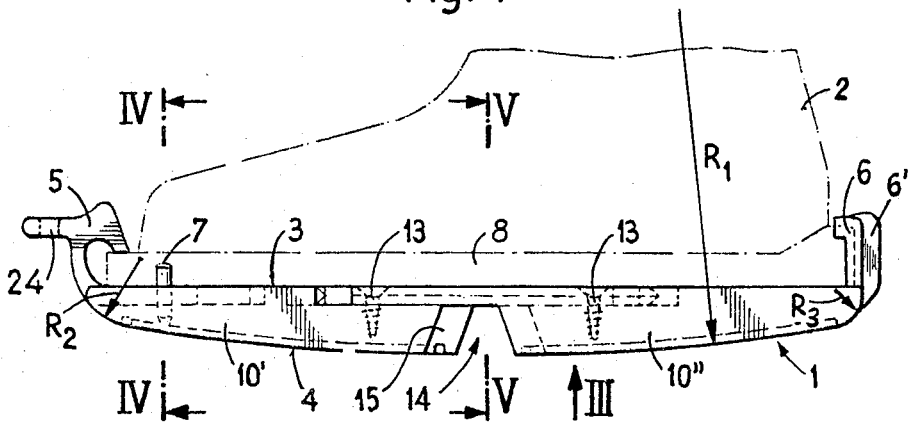
FIG. 1 is a side view of a sole attachment for facilitating walking, constructed according to the invention, showing the footwear, here assumed to be in the form of a ski boot in broken or phantom lines.

Describing now the drawings, in FIG. 1 there is illustrated a first exemplary embodiment of sole attachment 1 for facilitating walking, which is contemplated to be secured to a suitable article of footwear, here assumed to be a ski boot 2. The sole attachment 1 contains an upper surface 3 which is structured so as to be suitable to be applied to the not particularly referenced sole of the ski boot 2, and further contains a lower tread or contact surface 4 which is arched or domed in the direction of the ski boot sole 8. At the front end of the sole attachment 1 there is provided an attachment or securing device 5, and equally at the rear end of the sole attachment 1 there is provided an attachment or securing device 6. Additionally, suitable fixation means 7, here shown as protruding fixing or arresting pins, are provided at the upper surface 3 of the sole attachment 1. These fixation or arresting pins 7 can be introduced into appropriate openings or holes provided at the sole 8 of the ski boot 2.

Figure 2:
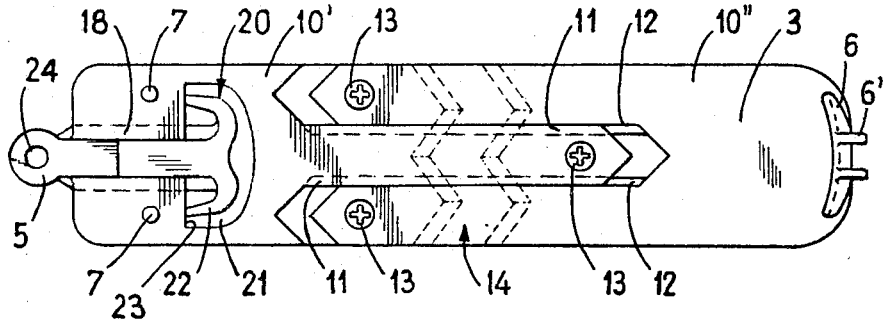
FIG. 2 is a top plan view of the sole attachment of FIG. 1.

As further apparent by referring to FIGS. 1 and 2, the sole attachment 1 is in the form of a plate or plate member, here composed of two plate portions or elements 10' and 10''. Both of the plate portions 10' andn 10'' are mutually telescopically adjustable with the aid of guide surfaces 11 and 12 provided at the respective plate portions 10' and 10'', respectively. The guide surfaces 11 and 12 can be constituted, purely by way of example, by a tongue and groove arrangement, as shown in FIG. 2, but of course any equivalent structure suitable to accomplish the same function can be provided. By virtue of this design it is possible to easily accommodate the sole attachment 1 to many different sizes of ski boots or the like. The fixation of both of the plate portions or elements 10' and 10'' in a given position can be accomplished by suitable fixing elements, here shown as screws or threaded bolts 13.

Figure 3:
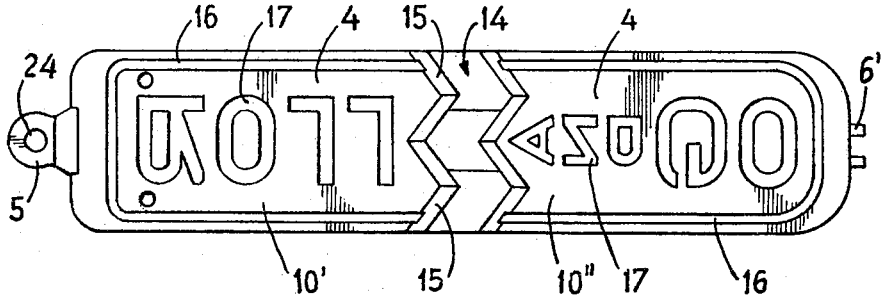
FIG. 3 is a bottom plan view of the sole attachment of FIG. 1.

Between both of the plate portions 10' and 10'' there is located a separation joint 14 which is bounded by surfaces 15 of the plate portion 10' and 10''. As particularly well seen by referring to FIGS. 1 and 3, the surfaces 15 are not only configured so as to extend in a zig-zag formation, but also are structured so as to be inclined with respect to the upper surface 3 and to the tread surface 4. Due to this construction there is achieved the beneficial result that, when both of the plate portions 10' and 10'' closely abut one another, there is nonetheless still left free a substantially wedge-shaped separation joint or gap 14. The latter is particularly beneficial in terms of preventing slipping of the sole attachment 1 upon snow or ice.

The tread surface 4 of the sole attachment 1 is additionally profiled or shaped so as to increase its antiskid or slipping properties. As best seen by referring to FIG. 3, a suitable manner of profiling the sole attachment 1 is by providing recesses or depressions 16 and 17 at the tread or contact surface 4. While the depression or recess 16 is shown to have the shape of a border or frame which essentially encloses the tread surface 4, the other depressions or recesses 17 are advantageously, although not absolutely necessarily, configured as letters of the alphabet. When these letters of the alphabet, as illustrated, are arranged in a mirror-image fashion, then apart from the anti-skid protection effect which is afforded by these depressions or recesses 17, the letters are impressed into the snow when walking thereon. Thus, a form of advertising can be realized by configuring the letters to portray a desired message, such as a brand name or mark.

Figure 4:
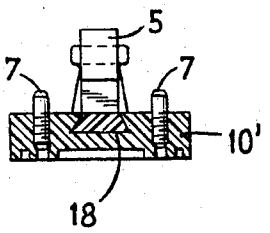
FIG. 4 is a sectional view, taken along the line IV—IV of FIG. 1.
Figure 5:
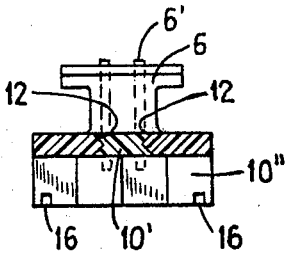
FIG. 5 is a sectional view, taken along the line V—V of FIG. 1.

As best seen by referring to FIGS. 1, 2 and 4, the holder element or part 5, constituting one of the attachment devices, is guided with the aid of, for instance, a standard dovetail guide arrangement 18 in the plate portion 10' and is equipped with a resilient end 20 located in a suitably formed recess 21 of the plate portion or element 10'. Resilient arms 22 of the end 20 bear against a surface 23 of the recess 21, and thus, draw the entire holder portion or element 5 towards the right of the showing of FIGS. 1 and 2. By virtue of the applied resilient or spring-like force the boot 2 is fixedly clamped at the sole attachment or undersupport 1 with the aid of the holder element 5. For purposes of releasing the ski boot 2 the holder element 5 can be provided with a release aid, here shown in the form of an eyelet 24, into which there can be introduced, for instance, the end of a ski pole, with the result that the holder element 5 then is shifted towards the left of the showing of FIG. 1, and hence the ski boot 2 is released.

As already mentioned, the right-hand holder element or portion 6 is as rigid as possible and for this purpose is beneficially provided with the stiffening ribs 6' or equivalent structure.

Figure 6:
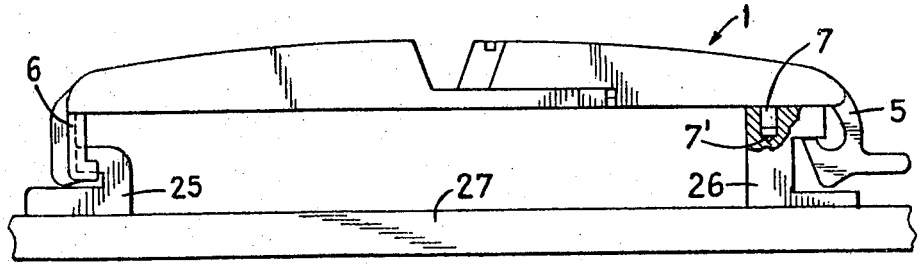
FIG. 6 illustrates an arrangement suitable for securing, with the aid of particular holders, the sole attachment at a ski.

Turning attention now to FIG. 6, there is shown therein a sole attachment 1 which with the aid of holders or mounting devices 25 and 26 can be secured releasably at a ski 27. The releasable fixation of the sole attachment 1 at the ski 27 is accomplished in the same manner as the sole attachment 1 is secured to the ski boot 2. For this purpose the holders or mounting elements 25 and 26 have a suitable configuration and mutual spacing from one another, as shown. One of the holders, here the holder 26, also is provided with recesses 7″ for receiving the fixation or fixing pins 7.

Figure 7:
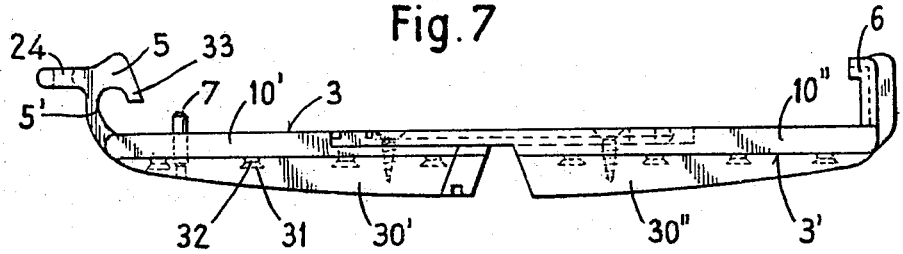
FIG. 7 is a side view of a further embodiment of sole attachment.

In FIG. 7 there is shown a further construction of sole attachment designed according to the invention. With this embodiment the plate portions or elements 10′ and 10″, which here are formed of a rigid plastics material, are provided at their lower or bottom face with a related flat or planar surface 3′ extending essentially in parallelism to the upper plate surface 3. At these lower surfaces 3′ there are secured the sole portions or elements 30′ and 30″. As illustrated, the attachment of the sole portions or elements 30′ and 30″, which can be fabricated of rubber or a soft plastics material, is accomplished by snapping these sole portions over widened or enlarged heads 31 of plugs or pins 32 or the like. The plugs or pins 32 together with their enlarged heads 31, in this case, advantageously can be formed of any suitable metal. With the embodiment of FIG. 7 the right-hand located holder element 6 is constructed in the same manner as with the embodiment of FIGS. 1 and 2. The left-hand holder element 5, on the other hand, is formed of one-piece or integrally with the plate portion or element 10′. The movement of the attachment device, in other words the holder element 5, out of its effectual clamping position into its ineffectual position and again back into the effectual clamping position here is exclusively accomplished by virtue of the elasticity of its arm 5′. The elastic arm 5′ of the holder element 5 interconnects the eyelet 24 and the beak-like end 33 of the holder element 5 with the plate portion or element 10′.

Figure 8:
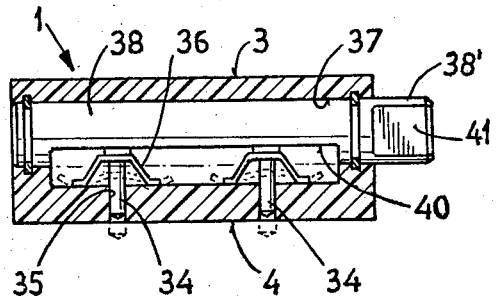
FIG. 8 is a cross-sectional view of a sole attachment equipped with anti-skid elements, here shown as ejectable pins for safeguarding against unintentional slipping of the user.

In FIG. 8 there is shown in cross-sectional view a sole attachment or undersupport 1 having an arrangement of two anti-skid elements, here shown as pins 34 which provide protection against undesired slipping of the user. The anti-skid pins 34 or equivalent structure are guided in bores or holes 35 of the sole attachment 1 and provided with springs 36 or equivalent resilient biasing means which draw the pins 34 upwardly into the illustrated position, i.e. into the sole attachment 1. At the location of the bores 35 containing the pins 34 there is formed a transversely extending or transverse bore 37 within which there is rotatably mounted a plug or shaft 38. This plug or shaft 38 has a recess or cut-out 40 containing a substantially flat surface extending in a chord-like manner with respect to the cross-section of the cylindrical shaft or plug 38. Additionally, the plug or shaft 38 has a protruding actuating or manipulating end 38′ which is provided with parallel gripping surfaces 41. When the plug 38 is turned with the aid of the gripping surfaces 41 through 180° with respect to the showing of FIG. 8, then a camming action is exerted upon the anti-skid pins 34 within the bores 35 which moves them downwardly and therefore, out of the tread surface 4 into the position shown in phantom lines in such FIG. 8. As mentioned, the pins 34, when outwardly extended, afford a good anti-skid protection for the user when walking upon icy or slippery surfaces. If the plug or shaft 38 is turned back into the illustrated position of FIG. 8, then the anti-skid pins 34 again are drawn back into the tread surface 4 so that they are not in their effectual or working position.

Reverting again to FIG. 1, there has been indicated therein the radii R1, R2 and R3, which govern the doming or arching of the tread surface 4 of the sole attachment or undersupport 1. The dimensions of the radii are not subject matter of the invention, but typical dimensions of such radii have been disclosed in the previously mentioned Swiss Pat. No. 516,290 to which reference may be readily had.

Figure 9:
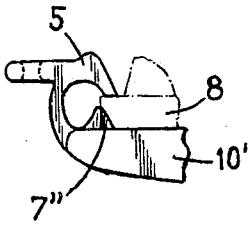

FIG. 9 shows a still further modification of the fixation element for preventing any lateral slipping of the sole attachment or undersupport 1 at the ski boot 2 or other footwear. As shown in such FIG. 9, the plate element 10′ is provided with a pointed, substantially wedge-shaped projection 7″ engaging into an appropriate cut-out or recess provided at the ski boot sole 8.

While there are shown and described present preferred embodiments of the invention, it is to be distinctly understood that the invention is not limited thereto, but may be otherwise variously embodied and practiced within the scope of the following claims. Accordingly,

What I claim is:

1. A sole attachment for footwear having a footwear sole and serving for facilitating walking, especially for use with ski boots, comprising:
   - a plate member having an upper surface intended to be applied to the sole of the footwear;
   - means provided for said plate member for forming a lower tread surface domed in the direction of the sole of the footwear;
   - attachment devices for securing the plate member at the footwear;
   - said plate member having opposed ends;
   - said attachment devices comprising a respective holder element provided at each end of the plate member;
   - each said holder element engaging over the sole of the footwear;
   - at least one of the holder elements being formed of one-piece with the plate member;
   - at least one of the holder elements being structured to be elastically movable between an effectual position for securing the plate member to the footwear and out of such effectual position into an ineffectual position; and
   - said plate member having an upper surface provided with at least one fixation means intended to be introduced into related recess means provided at the sole of the footwear.

2. The sole attachment as defined in claim 1, wherein:
   - said at least one holder element which is elastically movable defines the other of said holder elements.

3. The sole attachment as defined in claim 1, wherein:
   - said plate member comprises two mutually telescopically adjustable plate portions.

4. The sole attachment as defined in claim 3, wherein:
   - said plate member is provided at said plate portions with surface means extending transversely with respect to said lengthwise direction of the plate member;
   - said surface means delimiting a separation joint at the plate member; and
   - said surface means comprising inclined surface portions provided at said plate portions and which diverge with respect to the lower surface of the plate portions.

5. The sole attachment as defined in claim 1, wherein:

said elastically movable holder element is inherently elastic and is formed of one-piece with the plate member.

6. The sole attachment as defined in claim 1, further including:

means for movably mounting the elastically movable holder element with respect to the plate member; and said mounting means including elastic means for enabling movement of said elastically movable holder element with respect to the sole of the footwear.

7. The sole attachment as defined in claim 1, wherein:

said means forming the domed lower tread surface is formed at least at one sole portion secured to said plate member.

8. The sole attachment as defined in claim 1, wherein:

said means defining said lower tread surface is provided with recess means affording anti-slipping properties for the sole attachment; and said recess means being in the form of mirror-image letters of the alphabet.

9. The sole attachment as defined in claim 1, further including:

extendable and retractable anti-skid means provided for the lower tread surface.

10. The sole attachment as defined in claim 9, wherein:

said anti-skid means comprise extendable pin means.

11. The sole attachment as defined in claim 1, further including:

holder means for securing the sole attachment to a ski.

12. The sole attachment as defined in claim 1, wherein:

said at least one fixation means comprises two fixation pins provided for said plate member and intended to be introduced into bores constituting the recess means of the sole of the footwear.

13. The sole attachment as defined in claim 1, wherein:

said plate member is provided with a substantially wedge-shaped projection intended to engage into a cut-out provided at the sole of the footwear.

14. A sole attachment for footwear having a footwear sole and serving for facilitating walking, especially for use with ski boots, comprising:

a plate member having an upper surface intended to be applied to the sole of the footwear;

means provided for said plate member for forming a domed lower tread surface;

attachment means for securing the plate member at the footwear;

said plate member having opposed ends;

said attachment means comprising a respective holder element provided at each end of the plate member;

each said holder element engaging with the sole of the footwear;

at least one of the holder elements being formed integrally with the plate member;

at least one of the holder elements being structured to be elastically movable between an effectual position for securing the plate member to the footwear and out of such effectual position into an ineffectual position; and said plate member having an upper surface provided with at least one fixation means intended to be introduced into related recess means provided at the sole of the footwear.

* * * * *